United States Patent [19]

Kupersmit

[11] Patent Number: 4,596,355

[45] **Date of Patent: * Jun. 24, 1986**

[54] COLLAPSIBLE SHIPPING CONTAINER HAVING COLLAPSED PLANAR PROFILE

[76] Inventor: Julius B. Kupersmit, 145-80 228th St., Springfield Garden, N.Y. 11413

[ * ] Notice: The portion of the term of this patent subsequent to Oct. 25, 2000 has been disclaimed.

[21] Appl. No.: 576,935

[22] Filed: Feb. 6, 1984

[51] Int. Cl.[4] ..... B65D 5/56

[52] U.S. Cl. ..... 229/23 R; 220/400; 220/441; 220/468; 220/470; 229/41 R; 229/46

[58] Field of Search ..... 220/441, 443, 400, 468, 220/470, 403; 229/41 R, 41 B, 23 BT, 23 R, 48 R, 46

[56] References Cited

U.S. PATENT DOCUMENTS

| | | | |
|---|---|---|---|
| 705,953 | 7/1902 | Neihysel | 229/34 R |
| 728,749 | 5/1903 | McCord | 229/46 |
| 894,699 | 7/1908 | Rollestone | 229/41 R |
| 1,554,454 | 9/1925 | Miller | 229/41 R |
| 1,559,240 | 10/1925 | Fox | 229/41 R |
| 2,317,884 | 4/1943 | Clouston | 229/46 X |
| 2,392,575 | 1/1946 | Budge et al. | 383/122 X |
| 3,438,562 | 4/1969 | Connor et al. | 229/41 R X |
| 3,502,488 | 2/1970 | Bridsford | 229/33 X |
| 3,917,154 | 11/1975 | Dove | 229/41 R X |
| 4,272,009 | 6/1981 | Bamburg et al. | 229/41 R |
| 4,411,373 | 10/1983 | Kupersmit | 220/441 X |

*Primary Examiner*—Allan N. Shoap
*Attorney, Agent, or Firm*—Charles E. Temko

[57] ABSTRACT

An improved collapsible shipping container having a planar rectangular profile while in collapsed condition to permit improved stacking capability. The container includes a collapsible liner or reinforcing element having improved compression strength at the corners of the container when in erected and installed condition, thereby permitting maximum stacking capability when the container is in erected and loaded condition.

4 Claims, 8 Drawing Figures

COLLAPSIBLE SHIPPING CONTAINER HAVING COLLAPSED PLANAR PROFILE

BACKGROUND OF THE INVENTION

This invention relates generally to the field of collapsible reusable shipping containers of a type disclosed in my prior U.S. Pat. Nos. 3,358,049, granted Apr. 24, 1961; 4,411,373, granted Oct. 25, 1983; 4,231,149, granted Dec. 16, 1981; 4,252,266, granted June 7, 1980; and 4,405,077, granted Sept. 21, 1983. More particularly, the invention relates to improved constructions having superior stacking capabilities both in erected and collapsed state.

Such containers are characterized generally in the provision of a pallet-like "slip sheet" which replaces the conventional wood pallet, an open top box element, the sides of which are foldable to flattened condition to lie upon the slip sheet, a lid or cover element having short sides is then positioned upon the collapsed sides of the box element to form a generally rectangularly shaped planar unit several inches high which is capable of being stacked for storage or empty return shipment. Where additional compression strength is required, a collapsible liner element is provided to provide side walls of greater effective rigidity.

In erected condition, the lid or cover element is secured to the side walls using expandable clip elements which penetrate aligned openings in the cover element and walls and the end walls of the box element.

In my prior U.S. Pat. No. 4,405,077, there is disclosed an improved foldable side wall construction which enables the corner edges of all side walls to be rapidly collapsed and erected, and in which each corner as it is folded overlies an adjacent side in serial fashion. While convenient, this particular construction has been vulnerable to bulging in an upward direction under the influence of the resilience of the folded liner element which is stored in an uncollapsed lower portion of the box element. This bulging effect is transmitted to the cover element resulting in the upper surface of the cover element being moved from a horizontal plane causing collapsed containers position thereon to be tilted and slide from stacked condition. The bulging effect is cumulative, with each stacked unit, this effect severely reducing the stacking capability in collapsed condition.

Another serious problem with stacked containers when in erected and loaded condition is the compressive strength in a vertical direction, particularly at the corners of the container. The greater the compression strength the greater is the number of erected loaded units that may be stacked in a single column. To improve this aspect, it is known to provide a foldable reinforcing element, as disclosed in my U.S. Pat. No. 4,411,373, above mentioned. In certain applications, it is desirable to have a reinforcing element having compressive strength greater than is possible with the disclosed construction.

SUMMARY OF THE INVENTION

Briefly stated, the invention contemplates the provision of improved collapsible reusable shipping container construction of the class described in which the above discussed shortcomings have been substantially eliminated. In the present construction, there is provided a plurality of elastic cords, one preferably at each end of the container, the ends of which are anchored through openings in the side walls, and, depending upon the state of the container, the cords are selectively used to hold the cover element in position upon the box element, or to hold the collapsed box and cover element in substantially planar condition to eliminate the bulge which destroys the rectangularity of the collapsed unit. This construction not only eliminates the necessity of providing separate expandable clip elements, which are relatively expensive to manufacture, but prevents the accidental loss of cover-retention means which does occur in the case of the clip elements which are fully detachable. The cords are anchored within openings in the side walls of the container element by a simple knotting operation, and, where necessary, they may be replaced periodically should they lose their elasticity at relatively low cost, and with minimum expenditure of labor.

The invention also contemplates the provision of an improved collapsible reinforcing element in which by the provision of foldable flap members, the compression strength of the reinforcing element, and its associated container element have increased compressive strength at the corners thereof, where it is most required.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
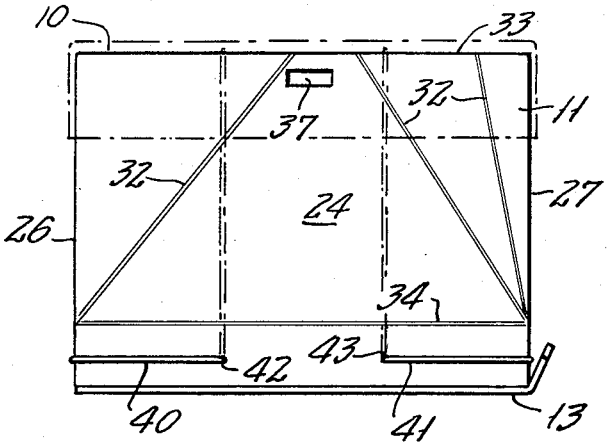
FIG. 1 is a side elevational view of a collapsible container embodying the invention, in erected condition with the cover element removed.
Figure 5:
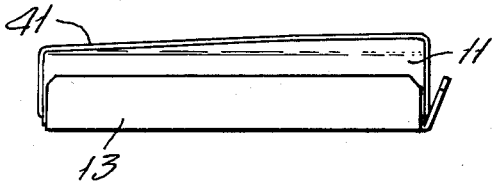
FIG. 5 is an end elevational view of the embodiment as seen from the right-hand portion of FIG. 3.
Figure 2:
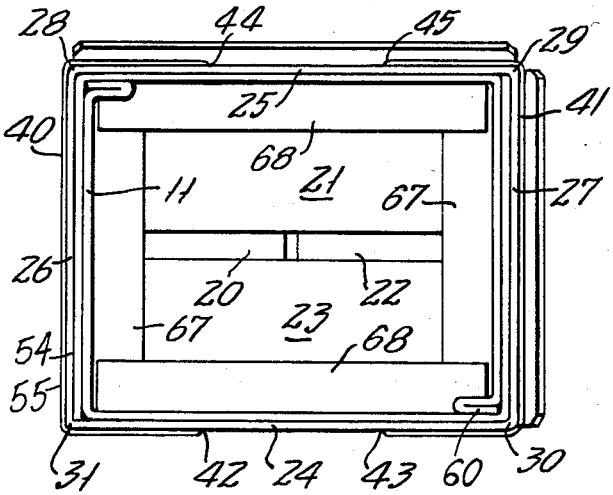
FIG. 2 is a top plan view thereof.
Figure 6:
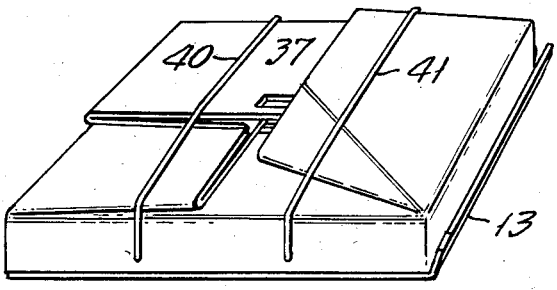
FIG. 6 is a perspective view of the embodiment in collapsed condition.
Figure 7:
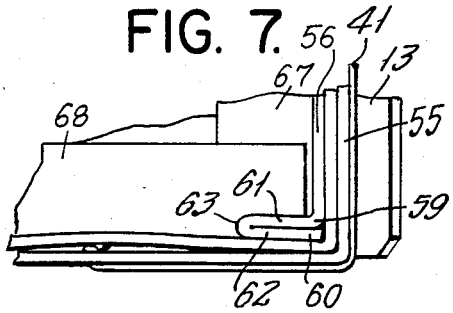
FIG. 7 is an enlarged fragmentary plan view corresponding to the lower right-hand portion of FIG. 2.
Figure 3:
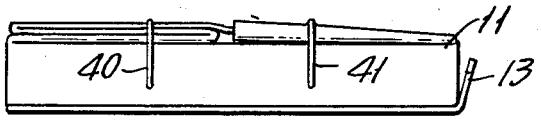
FIG. 3 is a side elevational view of the structure shown in FIG. 1 with side and end wall members thereof in collapsed condition.
Figure 8:
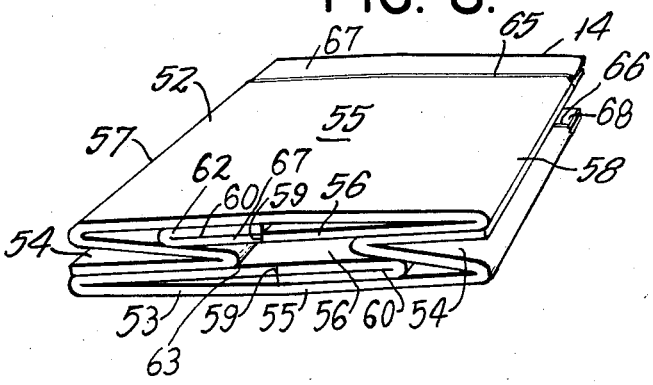
FIG. 8 is a perspective view of a reinforcing element in collapsed condition.
Figure 4:
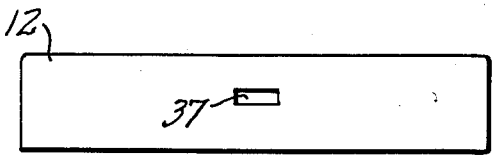
FIG. 4 is a side elevational view of a cover element.

In accordance with the invention, the device, generally indicated by the reference character 10, comprises broadly: a box element 11, a cover element 12, a slip sheet element 13, and a reinforcing element 14.

The box element 11 somewhat resembles that disclosed indicted my above mentioned U.S. Pat. No. 4,405,077. It includes a bottom wall formed by overlapping flaps 20, 21, 22 and 23, which are glued together in known manner. A pair of side walls 24 and 25, and a pair of end walls 26 and 27, extend upwardly from the bottom wall, and are interconnected at vertical side edges 28, 29, 30 and 31. Fold lines 32 are angularly disposed in accordance with the above mentioned patent, and extend between a continuous upper edge 33, and a continuous horizontal score line 34, disposed a short distance above the bottom wall. The score line thus limits the collapsible portion of side and end walls to that disposed thereabove, and forms a relatively rigid chamber therebelow for accommodation of the reinforcing element in the manner disclosed in my U.S. Pat. No. 4,411,373. Optionally, there are provided the usual rectangular openings 37 in both the side walls 24, 25 and the cover element 12 for engagement by clip means of known type.

First and second elastic cords 40 and 41 are engaged at the free ends thereof through openings 42, 43, 44 and 45 in the side walls 24 and 25, and are of such length as to always be under a degree of tension.

When the box element 11 is in erected condition, the cords may be allowed to lie on the outer surface of the end walls 26 and 27, so as not to interfere with loading or unloading through the open top. When it is desired to close the container by positioning the cover element 12, the cords are merely stretched and moved to overlie the cover element to resiliently retain it in position.

When the box element 11 is moved to collapsed condition in the manner disclosed in my U.S. Pat. No. 4,405,077, the cords will overlie the collapsed side and end walls tending to maintain them in planar condition, so that when the cover element 12 is positioned thereupon, it will also lie with its horizontal wall parallel to the bottom wall of the box element. This condition will occur irrespective of whether or not the reinforcing element 14 is positioned beneath the score line 34.

The reinforcing element 14 constitutes an improvement over that disclosed in my U.S. Pat. No. 4,411,373, in the provision of means for reinforcing a pair of diagonally exposed corners from the standpoint of compression strenth. The element includes first and second corrugated blanks 52 and 53 which are glued in overlapped relation as disclosed in that patent. Each blank includes a first foldable end wall 54, a relatively rigid side wall 55, and a second rigid side wall 56, which are interconnected by vertical fold lines 57 and 58. A third fold edge 59 interconnects a creased flap 60 having first and second mutually foldable portions 61 and 62 interconnected by a medially disposed fold line 63.

Each of the side and end walls 54 and 55 is provided with an upper fold line at 65 and 66, respectively, which interconnect flaps 67 and 68 which are inwardly foldable to substantially co-planar relation, and which serve to reinforce the lower corners of the reinforcing element and further rigidify the first end walls 54.

The erection and installation of the reinforcing element 14 resembles that disclosed in my U.S. Pat. No. 4,411,373, with the exception that the flaps 60 are folded upon the fold line 63 so as to be disposed essentially at a pair of oppositely disposed corners of the erected reinforcing element. This places an additional thickness of material at that location which further increases the compressive strength at a most critical location.

I wish it to be understood that I do not consider the invention limited to the precise details of structure as shown and set forth in this specification, for obvious modifications will occur to those skilled in the art to which the invention pertains.

I claim:

1. In an improved collapsible shipping container of a type including a generally rectangular box element including a foldable opposing side walls and opposing end walls, a bottom wall, and a separable cover element adapted to overlie said side and end walls when said container is in an erected and closed condition, the improvement comprising: at least one elastic cord having first and second ends secured to a pair of oppositely disposed foldable walls, and adapted to selectively overlie said cover element when in closed condition, and said foldable walls when in collapsed condition; said container having a medially disposed horizontally oriented scoreline, said side and end walls being foldable only in the area above said scoreline and defining an enclosed chamber below said scoreline for the reception of a reinforcing element in collapsed condition when each container is in collapsed condition, the ends of each elastic cord being secured to opposing walls in areas below said scoreline whereby to exert tension upon said side and end walls in collapsed condition, and retaining said reinforcing element within said chamber.

2. The improvement in accordance with claim 1 including a pair of elastic cords, one each being positioned adjacent each end of said container.

3. An improved collapsible reinforcing element for use in conjunction with a corresponding collapsible shipping container comprising: first and second corrugated blanks, each blank including a first foldable end wall, a side wall, and a second rigid end wall interconnected by fold lines, and a foldable flap member attached at a first fold line to a distal side end of said first end wall; each of said second mentioned end walls having a longitudinal generally medially disposed fold line extending between top and bottom edges thereof; a surface of said second end wall of each blank being secured to a surface of said first end wall of the other blank only in an area on the side of said longitudinal fold line distal from the side wall of the respective blank to which the respective longitudinal line pertains to allow the first end wall to be folded to collapse said reinforcing element; whereby when said reinforcing element is in erected condition, said foldable flap member is foldable upon itself about a second fold line to form an additional thickness of material at a pair of diagonally disposed corners of said reinforcing element to add to the compression strength thereof.

4. An improved reinforcing element in accordance with claim 1, further characterized in said side and end walls each having horizontal score lines parallel to a lower edge of each wall forming an inwardly foldable flap which reinforces the lower corners of said reinforcing element when in erected condition.

* * * * *